US007594778B2

(12) United States Patent
Baranoff

(10) Patent No.: US 7,594,778 B2
(45) Date of Patent: Sep. 29, 2009

(54) METHOD FOR PROTECTING SURFACES OF INFRASTRUCTURE IMPROVEMENTS IN A CONSTRUCTION ENVIRONMENT

(75) Inventor: Sergei C Baranoff, West Sacramento, CA (US)

(73) Assignee: Sergei Baranoff, West Sacramento, CA (US)

( * ) Notice: Subject to any disclaimer, the term of this patent is extended or adjusted under 35 U.S.C. 154(b) by 0 days.

(21) Appl. No.: 11/561,354

(22) Filed: Feb. 13, 2007

(65) Prior Publication Data

US 2007/0119002 A1 May 31, 2007

Related U.S. Application Data

(63) Continuation of application No. PCT/US2006/045227, filed on Nov. 21, 2006.

(60) Provisional application No. 60/739,356, filed on Nov. 22, 2005, provisional application No. 60/803,029, filed on May 23, 2006.

(51) Int. Cl.
*E01C 5/20* (2006.01)

(52) U.S. Cl. ..... 404/73

(58) Field of Classification Search ..... 14/69.5; 404/35, 73

See application file for complete search history.

(56) References Cited

U.S. PATENT DOCUMENTS

| | | | | |
|---|---|---|---|---|
| 1,384,114 | A | 7/1921 | Arnold | |
| 1,658,444 | A * | 2/1928 | King | 238/8 |
| 2,436,467 | A | 2/1948 | Winter | |
| 2,594,425 | A | 4/1952 | Hymen | |
| 3,315,292 | A | 4/1967 | Collins | |
| 4,368,553 | A * | 1/1983 | Perry | 14/69.5 |
| 4,697,294 | A * | 10/1987 | Schafer | 14/69.5 |
| 5,267,367 | A * | 12/1993 | Wegmann, Jr. | 14/69.5 |
| D346,256 | S | 4/1994 | Thomas | |
| 5,308,188 | A * | 5/1994 | Shaftner | 404/25 |
| 5,446,937 | A * | 9/1995 | Haskins | 14/69.5 |
| 5,673,517 | A * | 10/1997 | Stanclift | 49/468 |
| 5,836,028 | A * | 11/1998 | Petersen | 14/2.4 |
| 6,044,511 | A * | 4/2000 | Frost et al. | 14/69.5 |
| 6,067,681 | A * | 5/2000 | Zeinstra et al. | 14/69.5 |
| 6,309,137 | B1 | 10/2001 | Hirsch | |
| 6,422,784 | B1 * | 7/2002 | Pellegrino et al. | 404/17 |
| 6,675,422 | B1 * | 1/2004 | Kuykendall | 14/69.5 |
| 6,708,361 | B1 * | 3/2004 | Emerson, Jr. | 14/69.5 |
| 6,718,588 | B1 * | 4/2004 | Frederiksen | 14/69.5 |
| 6,745,422 | B1 * | 6/2004 | Emerson, Jr. | 14/69.5 |
| 2007/0294844 | A1 | 12/2007 | Gunnarson | |

* cited by examiner

*Primary Examiner*—Gary S Hartmann
(74) *Attorney, Agent, or Firm*—Fenwick & West LLP

(57) ABSTRACT

Useful in a construction environment, for example, the protection system is installed over a surface to be protected, various configurations of a protection system are installed over a portion of an infrastructure improvement, such as a sidewalk, curb, gutter, or other structure. Traffic crossing the surface of the infrastructure improvement is then directed over the protection system to avoid damage that could otherwise occur due to the application of topical weight directly on the surface. The protection system may include ramps that facilitate traffic over the protected surface.

20 Claims, 5 Drawing Sheets

METHOD FOR PROTECTING SURFACES OF INFRASTRUCTURE IMPROVEMENTS IN A CONSTRUCTION ENVIRONMENT

CROSS REFERENCE TO RELATED APPLICATIONS

This application is a continuation of International Application No. PCT/US06/45227, filed Nov. 21, 2006, which claims the benefit of U.S. Provisional Application No. 60/739,356, filed Nov. 22, 2005, and U.S. Provisional Application No. 60/803,029, filed May 23, 2006, both of which U.S. provisional applications are incorporated by reference in their entirety.

BACKGROUND

Presently, construction regulations across much of the country require that sidewalks, curbs, gutters, driveways, roads, and other infrastructure improvements be put into place in housing and commercial developments before the construction of the new houses and structures may begin. During the construction of the new houses and structures, however, these infrastructure improvements are typically subjected to a significant amount of construction-related traffic. The topical weight from this construction related traffic often exceeds vehicle weights of 10,000 pounds, or 5 tons, which can easily break or otherwise damage the surfaces of the infrastructure improvements. This damage creates a significant problem for the construction process, as it can increase the cost of construction and lower the value of the resulting homes and structures in the housing or commercial development. It may also create a negative environmental impact in the form of excess construction waste.

Rather than trying to protect these surfaces from damage, a standard practice in the industry is simply to allow the breakage and other damage to occur and then rebuild the damaged surfaces. Heretofore, this waste has been considered merely a cost of doing business in the industry. The construction industry has been forced to accept such a wasteful cost because, although some effort has been made to protect the surfaces to avoid damage, no acceptable solution was presented.

Some of the methods that have been used to address the problem include forming a mound of dirt over an area to be protected, placing stacked wood over the area, and bridging over the area with thick steel sheets (e.g., greater than one inch in thickness). But using materials that are intended for other purposes and are merely shoehorned into place rather than formed into a product for protecting the infrastructure improvement does not solve the problem because these approaches do not adequately distribute topical loads to avoid damage to a surface. Additionally, each of these approaches is unacceptable in for other reasons. For example, mounding dirt over the subject areas causes erosion and pollution problems, and the dirt can be hard to clean up once the construction is finished. Moreover, many governmental bodies restrict the placement of dirt and contaminants upon paved surfaces. Stacked wood causes a tripping problem and tends to move and splinter as traffic travels across it. The wood must also be placed and removed throughout the day to keep the area clear for pedestrian traffic. In addition, the wood does not cushion the impact of the passing weight, and it lacks flexural support at the edges of the subject material Steel sheets, because of their weight, are difficult to position and typically must be delivered and placed by a crane. Moreover, steel sheets often slip under weight or slam down on the subject areas to cause magnified pressure and damage to the concrete.

Another approach to the problem is to form the infrastructure improvement sufficiently strong to withstand the topical loads without additional protection. For example, a sidewalk may be formed from reinforced concrete. However, reinforced concrete is expensive and is typically reserved for foundation applications, not curbs and sidewalks and general infrastructures. Over-engineering an infrastructure surface to withstand topical loads during construction is thus inefficient.

Accordingly, there is a longstanding need for an effective, non-intrusive system that limits or completely eliminates damage and breakage that can occur to surfaces of infrastructure improvements during the construction process.

SUMMARY

To address these problems, embodiments of the invention provide an effective protection system that distributed topical weights over a surface to be protected to avoid damage thereto. These embodiments are simple and easy both to install before use and to remove once no longer needed. Various embodiments provide flexibility in configuring the protection system, allow continued use of gutters for their intended purpose, and comply with safety regulations for pedestrian traffic.

In one embodiment, a protection system for protecting an infrastructure improvement from construction traffic includes a body section and one or more ramps. The body section is configured to distribute a topical load over a surface of the infrastructure improvement, while the ramps are coupled to the body section and facilitate traffic over an elevation change caused by the height of the body section. The body section and ramps may comprise modular pieces that are attachable to and detachable from each other. Various configurations and arrangements are enabled by the protection system.

In another embodiment, a protection system for protecting an infrastructure improvement from construction traffic includes a top surface for receiving a topical load due to traffic crossing over the protection system. The protection system further includes an entry section that distributes the topical load over a surface adjacent to the infrastructure improvement (e.g., the ground) and an exit section that distributes the topical load over a surface of the infrastructure improvement. In this way, a transition between the infrastructure improvement and the bare ground (e.g., an unsupported edge of a sidewalk) can be protected. In one embodiment, the exit section contacts the surface of the infrastructure improvement away from the edge of the infrastructure improvement to avoid distributing the topical load to the edge of the infrastructure improvement, which is commonly a weak part of the structure particularly that is highly vulnerable to damage. The exit section may also comprise a step up from the ground, contacting the infrastructure improvement at an elevation above where the entry section contacts a surface adjacent to the infrastructure improvement.

In use, in one embodiment, the protection system is installed over a portion of the infrastructure improvement adjacent to a construction site. Construction traffic is then directed over the protection system rather than over the bare infrastructure improvement to avoid damage to the infrastructure improvement. When no longer needed, the protection system can be removed from the infrastructure improvement, for storage or use at another location.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

In one embodiment, a protection system is installed over an area of a surface of an infrastructure improvement that is to be protected from topical weight. As used herein, the term infrastructure improvements includes, without limitation, sidewalks, curbs, gutters, driveways, roads, and other surface structures found in a construction environment. These infrastructure improvements are typically made of one or more materials that can be joined in various combinations, including concrete, cement, masonry, brick, tile, paving stones, asphalt, grout, and any other materials used in such applications, and/or naturally occurring materials such as slate stone, flagstone, and other natural materials.

Figure 1:
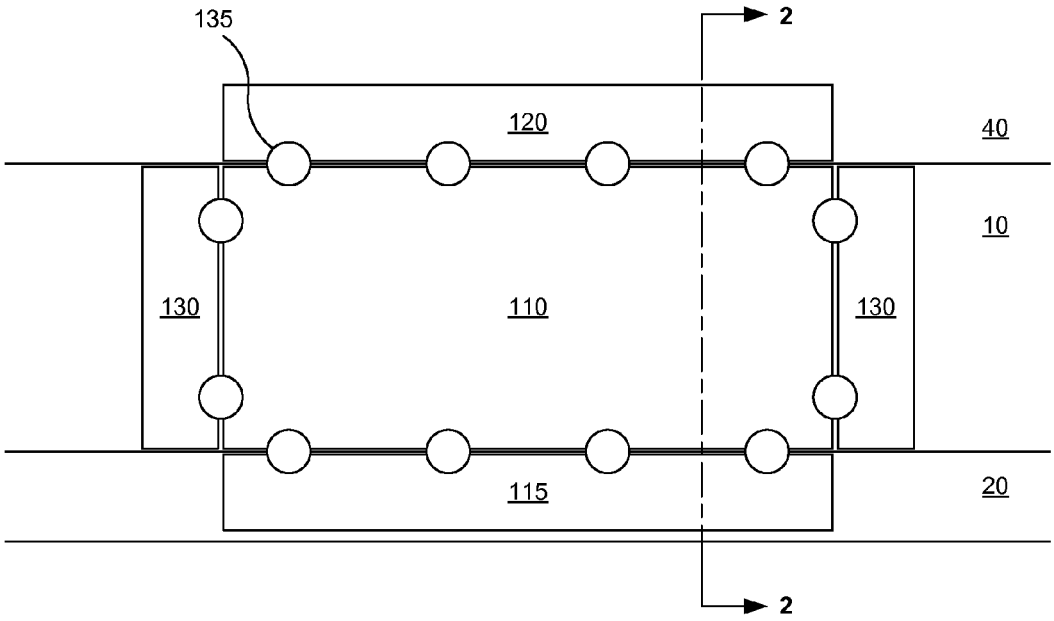
FIG. 1 is a plan view of a protection system for a surface of an infrastructure improvement, in accordance with an embodiment of the invention.
Figure 2:
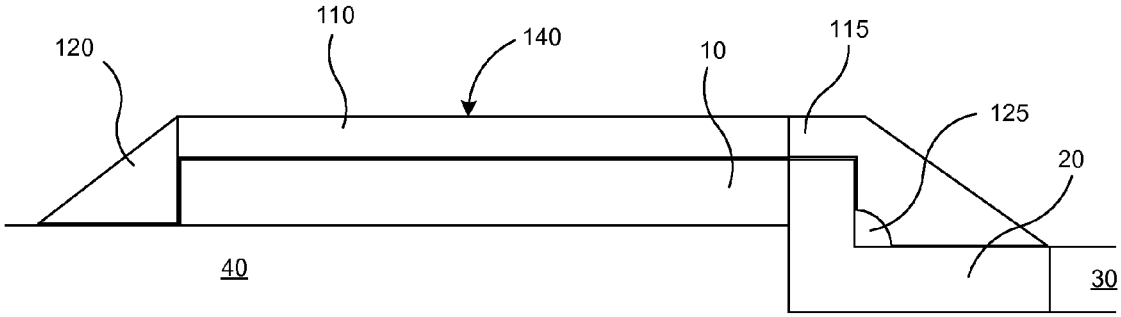
FIG. 2 is a cross-sectional side view of the protection system of FIG. 1, in accordance with an embodiment of the invention.

As shown in the plan view of FIG. 1, the protection system is installed over an area of an infrastructure improvement that includes a portion of a sidewalk 10 and a portion of a curb 20. FIG. 2 is a cross section of the protection system of FIG. 1 along the line 2-2 shown in FIG. 2. The curb 20 is typically the interface between the sidewalk 10 and a street, and the curb 20 typically includes an elevation change and a provision for a gutter to allow runoff of water from the street to a drain. This installation is just one example of an arrangement for an embodiment of the protection system, and this and other embodiments of the protection system may be installed over different kinds of surfaces and/or in different arrangements to provide corresponding protection from damage due to topical weight.

In this embodiment, the protection system comprises a cushioning membrane 110. The cushioning membrane 110 is designed to distribute topical weight across a large surface area, thereby reducing or eliminating breakage or damage to the surface thereunder. This cushioning membrane 110 may comprise engineered bladder cells pressurized with air, such as materials known as Profile Technology, manufactured by Dielectrics Industries, Inc., and the like. The cushioning membrane 110 may also comprise gel and/or air infused bladder cells to help distribute weight applied to the top surface. Alternatively, the cushioning membrane 110 may comprise recycled tire rubber, both extruded and pour molded, or any type of foam. The cushioning membrane 110 may alternatively use water, sand, soil, gel-filled beads, plastic beads, wooden beads, shredded and/or chipped wood, shredded and/or chipped rubber, or ballistic foam, or any of a variety of other materials useful for distributing weight, contained in a cell-like structure to enhance the cushioning capabilities of the cushioning membrane 110. In some embodiments, cells used in the cushioning membrane may have a geometric arrangement, including hexagonal, cylindrical, or other arrangements as appropriate for providing support and weight distribution. These alternatives may be used alone or in conjunction with each another.

Because this cushioning membrane 110 sits atop and thus adds to the height of the surface it is protecting, a front ramp 115 and/or a back ramp 120 may be provided. The front ramp 115 and a back ramp 120 may be used to provide a smoother transition for traffic passing over the cushioning membrane 110. The ramps 115, 120 may comprise the same material and structure as the cushioning membrane 110, or they may comprise other materials, including ABS plastic, recycled tire rubber, oil-based rubber materials, pressed wood, shaped wood, extruded steel, stamped steel, aluminum extrusions, or any other suitable material. The ramps 115, 120 may also comprise cells filled with a material (such as gel, water, air, sand, or the like) affixed to the top portions thereof.

The protection system may further include left and right side ramps 130 to provide a smoother height transition for traffic passing laterally over the system (e.g., for travel along a sidewalk). Beneficially, the weight from the ramps 130 along the edges of the cushioning membrane 110 may also help keep the cushioning membrane 110 from moving unpredictably or otherwise shifting during use. In one embodiment, each of the ramps 130 is designed with appropriate geometry to comply with any applicable ADA rules or other statutes or regulations, such as the allowable slope of the ramps 130 or allowable obstructions.

To facilitate assembly and to keep the ramps 115, 120, 130 in place during operation, the ramps 115, 120, 130 may be attached to the cushioning membrane 110 by one or more connecting joints 135 along the perimeter of the membrane 110. The connecting joints 135 may comprise any suitable connection mechanism that allows for attachment and detachment of the ramps 115, 120, 130 to the membrane 110 regardless of position. This may include tongue and groove joints, mortise and tenon joints, dovetails, biscuit joints, fitted sleeves, eye-bolts, zipper configurations locks, cables (such as steel or plastic), or any of a variety of suitable methods. The connecting joints 135 may be further reinforced using a pin or rod, made of steel, engineered plastics, aluminum or similar strength materials, placed horizontally through the center of the joint area. Alternatively, the ramps 115, 120, 130 may be formed integral with and thus permanently attached to the membrane 110. For example, the protection system may be a single unit made of a material, such as preformed resin, shaped to conform to concrete, sidewalks, curbs, gutters, and driveways to protect them from damage due to topical weight.

In another embodiment, the unit is nestable to allow the cushioning membrane 110 to be expanded to accommodate longer distances. For example, it may be desirable to expand the protection system in length, width, or both in the event a larger surface needs protection. This capability may also eliminate or reduce the need to introduce additional parts, such as additional cushioning membranes 110, to expand the system beyond the original size.

In one embodiment, the front ramp 115 conforms to and protects a curb 20 while preserving the functionality of a gutter. This feature is shown in FIG. 2, where the front ramp 115 includes a hollowed portion 125 of its cross section to allow flow through a gutter at the curb 20. Although a 90-degree edge is shown for the curb 20, the front ramp 115 can be designed to conform to other types of curbs used in the industry, such as 45-degree, rolled, and other types of curbs. As shown, the front ramp 115 significantly conforms to the curb 20 to spread out forces applied to the top of the front ramp 115, but it may also include the section 125 that is hollowed out, piped, or otherwise configured to allow flow. This allows water to flow through the gutter unblocked by the ramp 115, thus preserving the functionality of the gutter. This hollowed section 125 may be filled with a perforated material so as to allow the unrestricted flow of water while also filtering any larger contaminants that may have been introduced into the water due to construction activities. This perforated material may comprise materials such as hollow cell foam, straw, hay, or another material having suitable filtering properties. The filtering material may also be affixed through an independent attachment, thereby allowing the replacement of the material when its filtering properties are no longer be needed or when the material needs to be replaced.

As illustrated in the side view of the protection system shown in FIG. 2, the front ramp 115 may be configured to provide a smooth height transition not just for the height of the cushioning membrane 110, but also for the elevation difference between a sidewalk 20 and a curb 10. Similarly, the back ramp 120 may provide an elevation transition for the height difference between the sidewalk 10 and ground 40 over which the sidewalk is situated as well as the eight of the cushioning membrane 110. Accordingly, the back ramp 120 may protect a back edge of the sidewalk 10, and the front ramp 115 may protect a front edge of the sidewalk and the curb. The cushioning membrane 110 then covers the upper surface of the sidewalk 20 and connects the front and back ramps 115, 120, thus protecting the sidewalk 20 from traffic that crosses the sidewalk 20.

The protection system may further include an outer skin 140 that covers the cushioning membrane 110 and/or ramps 115, 120, 130. The outer skin 140 may help to protect the membrane 110 and/or ramps 115, 120, 130 from damage from the elements and other damage as well as provide a surface upon which grooves or ridges may be added to improve traction. In one embodiment, a shell is used to envelop the cushioning membrane to protect it from damage during use.

Figure 3:
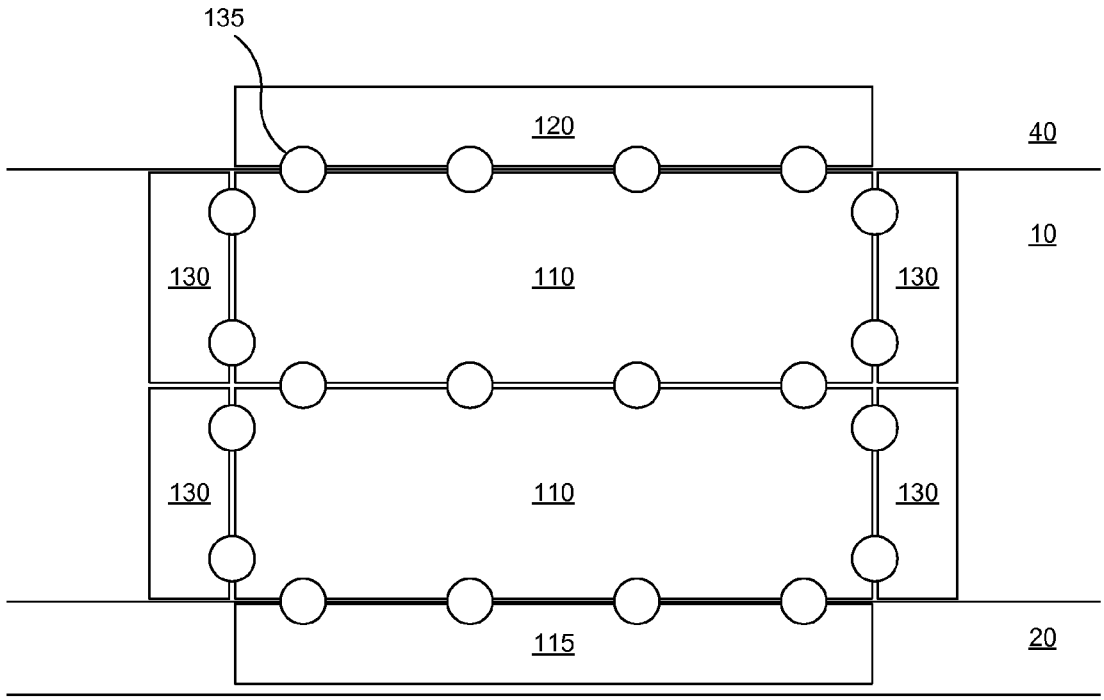
FIG. 3 is a plan view of a protection system with multiple segments arranged to cover a portion of a surface, in accordance with an embodiment of the invention.
Figure 4:
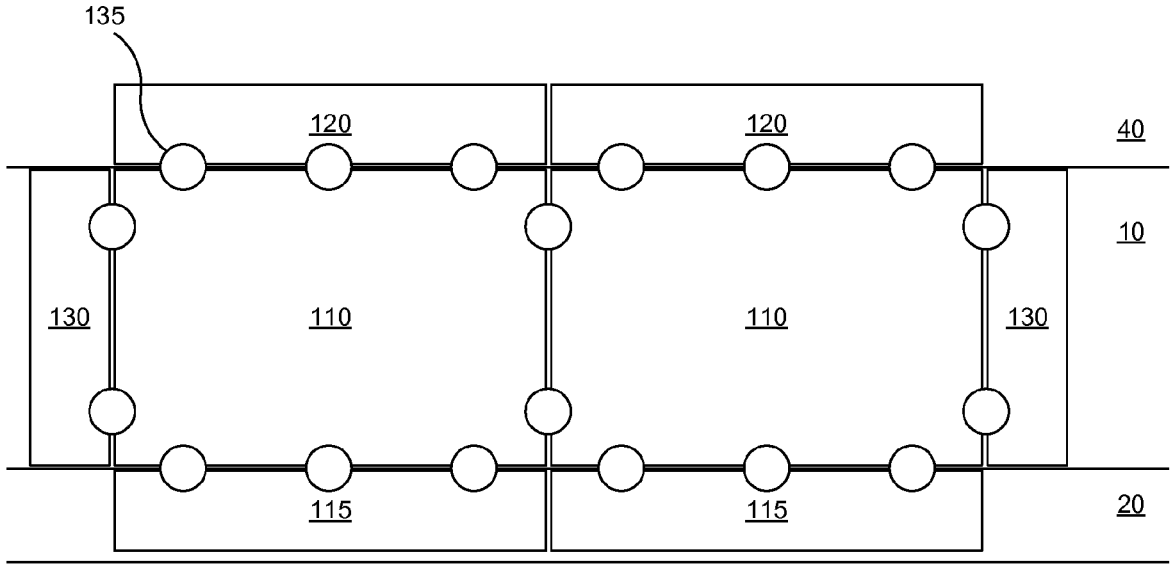
FIG. 4 is a plan view of a protection system with multiple segments arranged to cover a portion of a surface, in accordance with an embodiment of the invention.

In one embodiment the protection system has a modular design that allows for different configurations of multiple cushioning membranes 110 as well as the front, back, and side ramps 115, 120, 130 connecting thereto. FIG. 3 is a plan view of an example configuration of such a modular system, in which multiple cushioning membranes 110 are used, for example, for a deep sidewalk. The cushioning membranes 110 may be connected to each other using connecting joints 135 in a similar way that they are connected to the ramps 115, 120, 130. FIG. 4 shows another configuration of a modular embodiment of the protection system, where the cushioning membranes 110 are connected side-by-side, for example, to provide a wider protected path over a sidewalk 20. This may be useful for allowing larger equipment or simply more traffic to traverse the sidewalk 20. Accordingly, it can be appreciated that in some embodiments a modular design allows the protection system to be used to protect a variety of surfaces without requiring custom-fit systems for any particular purpose. The ability to disconnect the cushioning membranes 110 into sections smaller than the ultimate area to be protected also enables the system to be more easily transported and installed with less labor and difficulty.

Beneficially, embodiments of the surface protection system can be easily delivered to the subject area, installed before use, and then removed when no longer needed. In one embodiment, the system is installed by laying the middle cushioning membrane 110 over an area of a surface that the user intends to protect. Each of the ramps 115, 120, 130, if desired, is then placed along the edges of the cushioning membrane 110. The ramps 115, 120, 130 may be attached to the cushioning membrane 110, e.g., using connecting joints 135. With the system in place, the user can perform whatever construction or maintenance is to be done (which may include construction, remodeling, repairs, landscaping, and other activity) by crossing the protected surfaces instead of the unprotected surfaces. This avoids damage to the sidewalk, gutter, curb, driveway, and/or any other integrated structure. Once the construction or maintenance is completed, the system can be disassembled by disconnecting the ramps 115, 120, 130 and removing the pieces of the system from the surface. The mobility of the system allows it to be carried from one location to another with relative ease.

Embodiments of the protection system may be highly mobile, and as such they may be prone to theft or unauthorized removal. Such activity may be significantly reduced and or eliminated through the use of a tracking system, which may comprise an integrated global positioning technology, radio frequency identification, or the like installed in random areas of the protection system. Tracking systems attached to the protection system may also enable business models for the systems, such as licensing the systems on a per-use or per-location basis.

Another use of the cushioning membranes 110 may arise in construction and many other industries and applications, where staging and or storage of extremely heavy material occurs on areas not intended for such extreme topical weight. For example, disposal containers are often required at building sites and are typically placed upon the street. When loaded, these containers become increasingly heavy, inducing extreme pressure upon the street surface as well as utilities below. By assembling multiple cushioning membranes 110, a pad-like surface can be created upon which these containers may be placed. As when used to help reduce the negative effects of passing weight upon surfaces of infrastructure improvements, this use of the protection system would similarly reduce the negative impact of standing weight upon the same or similar surfaces.

It can also be appreciated that any of the parts of the protection system described herein could be used alone or in connection with less than the full system described, depending upon the site requirement. For example, a particular ramp section may be used without a middle cushioning membrane 110 in the event that a curb or gutter must be crossed but not a sidewalk section. Alternatively, in such a scenario a second ramp could be used by attaching it to the first ramp in the same manner as one would if a middle membrane were present, thereby proving protection for a curb and gutter. A variety of other configurations are possible given the parts of the protection system described herein. Accordingly, the protection system may be designed to protect any portion of the infrastructure improvement for which protection is needed most.

Figure 5:
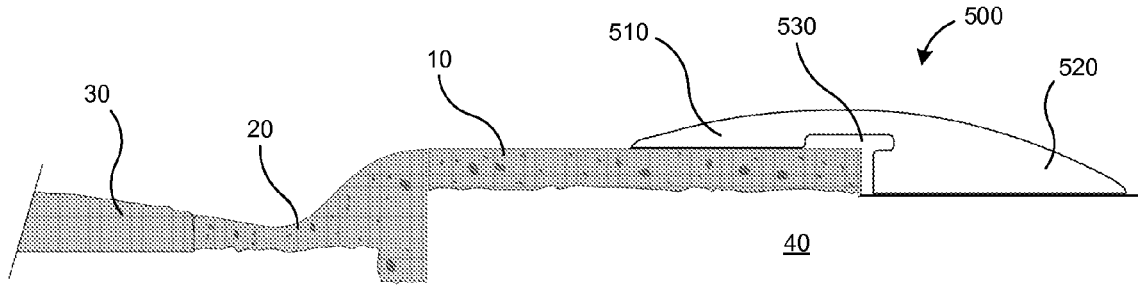
FIGS. 5-7 are cross-sectional side views of different embodiments of a protection system designed to protect a rear edge of a sidewalk or similar surface.
Figure 6:
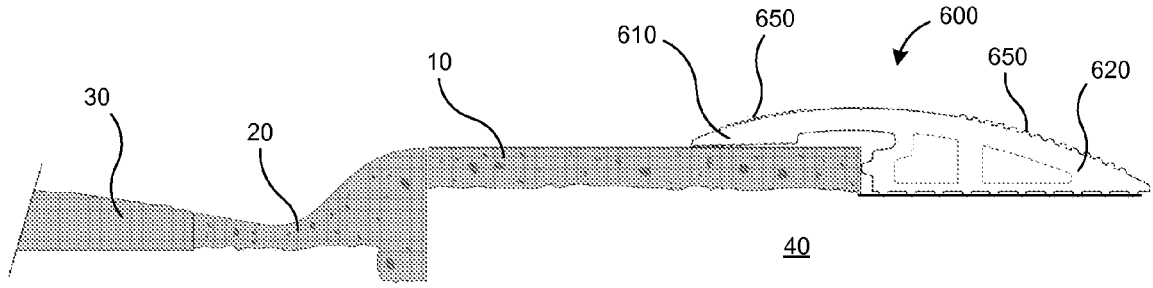
Figure 7:
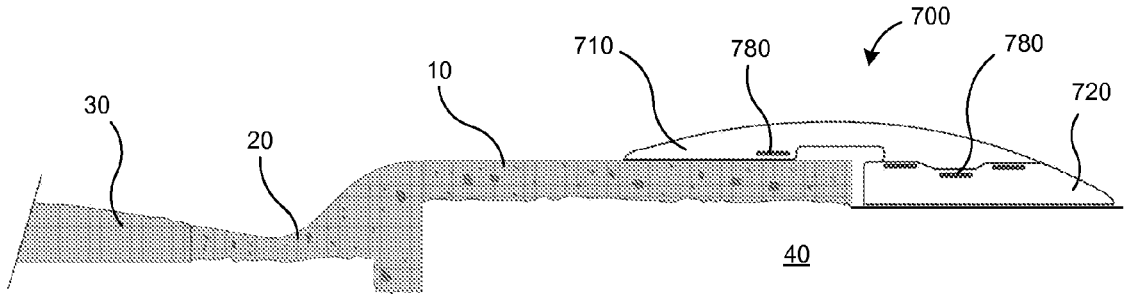
Figure 8A:
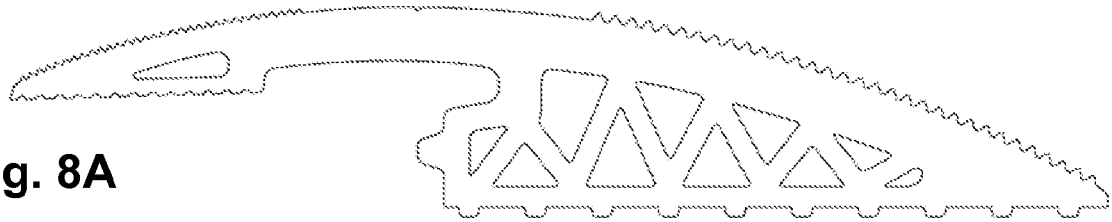
FIGS. 8A through 8D are side views of the sidewalk edge protection system illustrated in FIG. 6, in accordance with various embodiments thereof.
Figure 8B:
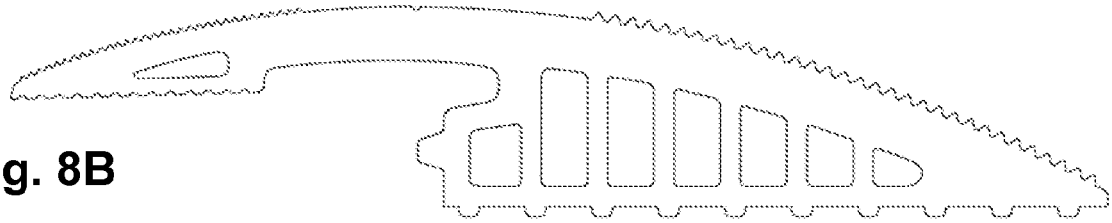
Figure 8C:
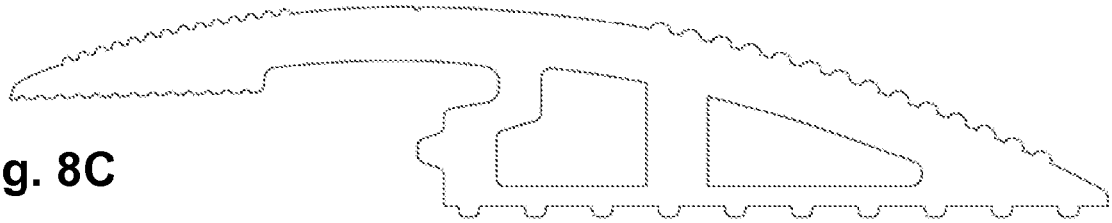
Figure 8D:
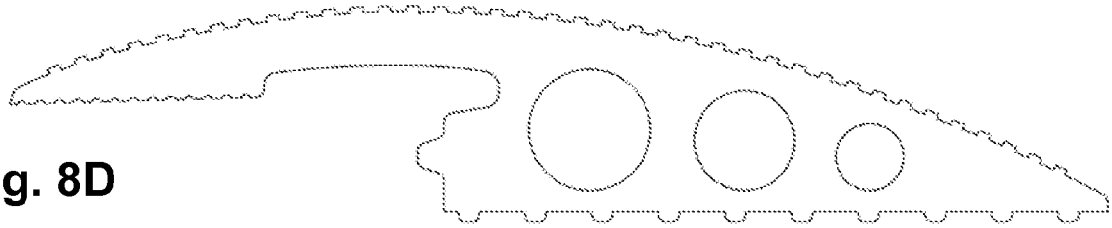

In one embodiment, a single unit including a front and back ramp section may be comprised from a membrane or material with cushioning or supporting attributes. This unit may then be placed over a particularly weak section of the infrastructure improvement, which is typically the unsupported rear edge of the sidewalk facing away from the curb. When placed over the weak portion, the protection system disperses a load, which would have otherwise been focused on the weak portion, over a larger portion of the infrastructure improvement. This reduces the load the weak portion must carry, thereby reducing the risk of damage to the infrastructure. FIGS. 5 through 7 illustrate a side view of various embodiments of a protection system designed to protect a weak rear edge of the sidewalk.

FIG. 5 illustrates a solid protection system 500 shaped to cover the rear edge of the sidewalk or other similar surface. The protection system 500 includes an exit ramp portion 510 and an entry ramp portion 520, allowing ingress to and egress from a sidewalk 20. This protection system 500 may be formed of a solid foam (or any suitable material described herein) for absorbing and dispersing weight applied to a top surface thereof. Because of the height difference between the sidewalk 10 and the ground 40, the exit and entry ramp portions 510,520 provide a smooth transition for traffic moving onto and off of the sidewalk via the system 500.

As illustrated, the system 500 may be designed with a gap 530 to be located at or near a corner or edge of the sidewalk 20. The gap 530 avoids application of weight directly to the edge of the sidewalk 20, which is usually the most susceptible to cracking or other damage because it is unsupported. (Although the edge of the sidewalk is technically supported by whatever ground is underneath it, the term unsupported is used herein to indicate an edge that is supported only by the ground and has no adjacent infrastructure improvement.) In one embodiment, the exit ramp portion 510 contacts the sidewalk 20 at least six inches from the edge thereof, although other distances may be used depending on the infrastructure improvement to be protected.

FIG. 6 illustrates another embodiment of a protection system 600 designed to protect a rear edge of a sidewalk 20. The protection system 600 also includes an exit ramp portion 610 and an entry ramp portion 620, allowing ingress to and egress from a sidewalk 20. The protection system 600 may comprise one or more structural members, constructed for example of a metal or other solid material designed to support a sufficient weight. The system 600 may further include traction ribs 650 to facilitate travel over the inclined system 600 and avoid slippage. These traction ribs 650 or other similar surface features beneficially increase the traction of vehicles and people that are traveling over the system 600, which may be especially important if the system 600 is made from a material that would otherwise be smooth and slippery when wet.

The system 600 may comprises a plurality of members that have a cross section such as that shown in FIG. 6, which members may be attached side-by-side to each other to create an appropriate width for the traffic crossing the sidewalk. The members may be formed with various other cross sections, such as those shown in FIGS. 8A through 8D. These cross sections have material removed therefrom in strategic locations, reducing the weight of the system while maintaining the majority of the support strength.

FIG. 7 illustrates another embodiment of a protection system 700 that includes exit and entry ramp portions 710,720 designed to be located over an edge of a sidewalk 20. The protection system 700 incorporates energy absorbing foam 780 that absorbs energy from traffic over the system 700 rather than transferring that energy to the sidewalk 20 and ground 40 therebelow. When heavy traffic passes over the protection system, the energy absorbing foam 780 provides additional cushioning to protect the infrastructure improvement. In one embodiment, the energy absorbing foam 780 is placed between the load-bearing exit ramp portion 710 of the protection system 700 and the surface of the sidewalk 20 to be protected. The system may further include a sectioned entry ramp portion 720, where the energy absorbing foam 780 is placed between the two sections. Alternatively, the foam 780 may be placed between the entry ramp portion 720 and the ground 40, without the need for a sectioned entry ramp portion 720, or that portion of the foam 780 may be omitted, e.g., when there is less need to avoid transferring energy to the ground 40. The energy absorbing foam 780 may be particularly useful to absorb rapid changes in a topical load, since the foam 780 may include significant damping properties in additional to its resilient properties. In alternative embodiments, other materials may be used in place of the energy absorbing foam 780, including other materials with heavy damping and resilient properties, such as viscoelastic materials.

In one embodiment, the protection system comprises two or more parts that can be separated. This allows the protection system to be disassembled, thereby facilitating the transport and storage of the protection system.

Figure 9:
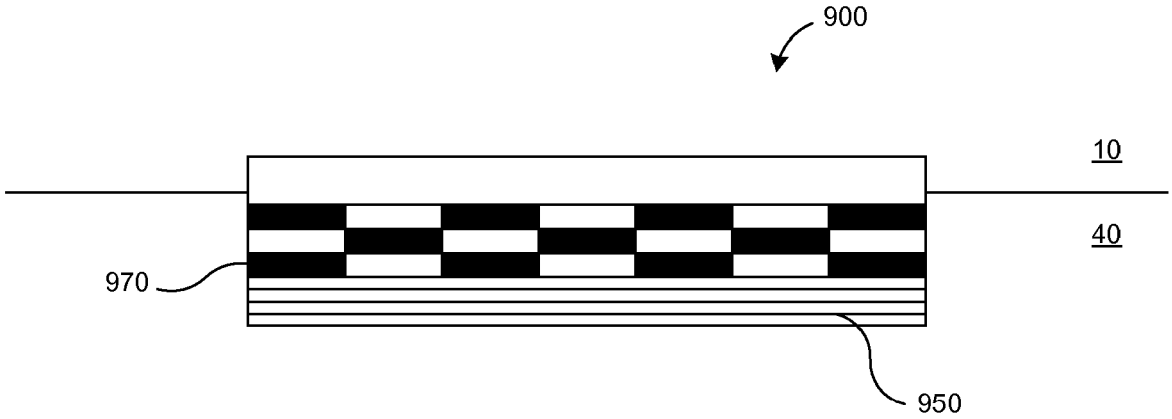
FIG. 9 is a plan view of a protection system having openings and traction ribs, in accordance with an embodiment of the invention.

As shown in FIG. 9, an embodiment of the protection system 900 includes a plurality of openings 970 to allow soil, water, and other particulates to pass through the system to the ground below it. The openings 970 may be placed, for example, on a portion of the system 900 that is designed to be located over the ground 40, rather than over the sidewalk 20. In this way, tracked material can fall through the openings 970 to the ground 40, thereby reducing material that is tracked onto the surface of the infrastructure improvement. Although shown in a checkerboard pattern in FIG. 9, the openings 970 may have any other pattern as suitable for allowing fluids and/or particles to pass through. For example, if the protection system 900 is implemented as a plurality of elements having a side view as shown in FIGS. 5-7, the openings 970 may be formed by spacing the elements apart so that fluids and/or particles can fall between the elements and through to the ground 40. As debris or other material fills the openings 970, it may act as a stabilizer for the unit. In alternative embodiments, the protection system 900 may comprise cavities to trap debris.

The protection system 900 may also includes traction ribs to increase the traction for traffic traveling over the slope of the unit. The protection system 900 may further include traction ribs 950, as described above, to facilitate travel over the system, 900. The traction ribs 950 may be additionally helpful where system is placed across an elevation change, as shown in the side views of FIGS. 5-7.

In one embodiment, the protection system comprises one or more handles to facilitate placement and movement of the structure. It can be appreciated that the placement, shape, and other design features of the handles will depend on the specific design of the protection system and the way in which it is intended to be installed and used. Accordingly, a variety of designs may be implemented with embodiments of the protection system described herein.

In another embodiment, the protection system can be temporarily fixed in place once it is installed to limit the movement of the system. For example, the protection system may include holes or other openings through which rods, spikes, or similar structures may be driven and into the ground thereunder. In this way, the protection system can be installed and then temporarily fixed in place to avoid unintended movement of the system.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It should be noted that the language used in the specification has been principally selected for readability and instructional purposes, and it may not have been selected to delineate or circumscribe the inventive subject matter. Accordingly, the disclosure of the embodiments of the invention is intended to be illustrative, but not limiting, of the scope of the invention, which is set forth in the following claims.

What is claimed is:

1. A method for protecting an infrastructure improvement from construction traffic at a construction site, the method comprising:

installing a protection system over a portion of the infrastructure improvement adjacent to the construction site, the protection system comprising a body section arranged to distribute a topical load over a surface of the infrastructure improvement, wherein the installing comprises installing the protection system over a nonlinear elevation change of the infrastructure improvement so that the protection system simultaneously provides a continuous path onto the protection system and a continuous path off of the protection system;

directing construction traffic along the continuous path onto the protection system, over the protection system, and along the continuous path off of the protection system, to avoid damage to the infrastructure improvement;

distributing, by the protection system, weight from the construction traffic to each of a plurality of surfaces having different elevations; and removing the protection system from the infrastructure improvement.

2. The method of claim 1, wherein the protection system further comprises one or more ramps coupled to the body section to facilitate construction traffic over the protection system, and wherein the construction traffic is directed via the ramps over an elevation change caused by a height of the body section.

3. The method of claim 1, wherein the protection system further comprises an entry section and an exit section, and wherein installing the protection system comprises placing the entry section over at least a portion of surface adjacent to the infrastructure improvement and placing the exit section over at least a portion of a surface of the infrastructure improvement.

4. The method of claim 3, wherein the installing comprises installing the protection system so that the exit section contacts the surface of the infrastructure improvement at an elevation above where the entry section contacts the surface adjacent to the infrastructure improvement.

5. The method of claim 1, further comprising:

after installing the protection system, fixing the protection system in place by attaching the protection system into ground adjacent to the infrastructure improvement.

6. The method of claim 1, further comprising:

placing an energy-absorbing material between the protection system and the infrastructure improvement.

7. The method of claim 1, wherein installing the protection system comprises connecting a plurality of modular sections to form the protection system.

8. The method of claim 1, wherein installing the protection system comprises connecting one or more ramps to the protection system.

9. The method of claim 1, wherein the surface of the protection system comprises traction ribs.

10. The method of claim 1, further comprising:

passing debris from construction traffic through one or more openings in the surface of the protection system.

11. The method of claim 1, wherein the infrastructure improvement comprises a sidewalk.

12. The method of claim 1, wherein the infrastructure improvement comprises a curb.

13. The method of claim 1, wherein the infrastructure improvement comprises a gutter.

14. The method of claim 11, wherein the directing comprises directing the construction traffic in a direction transverse to the sidewalk.

15. The method of claim 1, wherein the installing comprises installing the protection system over an unsupported edge of the infrastructure improvement, and wherein the distributing comprises the protection system distributing weight to the unsupported edge and to the surface of ground adjacent to the unsupported edge.

16. The method of claim 15, wherein the installing further comprises installing the protection system over the unsupported edge that is adjacent to a surface of ground having no additional improvements thereover.

17. The method of claim 15, wherein the distributing comprises the protection system distributing weight from the construction traffic to the infrastructure improvement and to the ground.

18. The method of claim 15, wherein the installing further comprises installing the protection system over the unsupported edge of the infrastructure improvement and the surface of ground adjacent to the unsupported edge, the infrastructure improvement and the surface of ground forming an elevation change therebetween.

19. The method of claim 15, wherein the installing further comprises installing the protection system over the unsupported edge that is an edge of a sidewalk that is opposite another edge of the sidewalk that abuts a curb.

20. The method of claim 1, wherein the distributing comprises distributing weight from the construction traffic to two surfaces having different elevations without contacting an edge between the two surfaces.

* * * * *